United States Patent [19]

Fukuchi et al.

[11] Patent Number: 4,576,466

[45] Date of Patent: Mar. 18, 1986

[54] DEVELOPING SYSTEM FOR AN ELECTROSTATIC COPYING APPARATUS

[75] Inventors: Masakazu Fukuchi, Hachioji; Keiji Oishi, Hino, both of Japan

[73] Assignee: Konishiroku Photo Industry Co., Ltd., Tokyo, Japan

[21] Appl. No.: 477,016

[22] Filed: Mar. 21, 1983

[30] Foreign Application Priority Data

Mar. 24, 1982 [JP] Japan ..... 57-46999

[51] Int. Cl.[4] ..... G03G 15/08

[52] U.S. Cl. ..... 355/3 DD

[58] Field of Search ..... 355/3 R, 3 DD; 222/DIG. 1

[56] References Cited

U.S. PATENT DOCUMENTS 3,883,240 5/1975 Ito et al. ..... 355/3 DD
4,173,405 11/1979 Swapceinski et al. ..... 355/3 DD
4,354,763 10/1982 Koiso et al. ..... 355/3 DD X
4,457,613 7/1984 Kopp et al. ..... 355/3 DD

*Primary Examiner*—Fred L. Braun
*Attorney, Agent, or Firm*—Frishauf, Holtz, Goodman & Woodward

[57] ABSTRACT

A developing system for an electrostatic copying apparatus has a primary spiral screw for conveying developer (including at least toner) in one direction with respect to the width of an area to be developed, and a secondary spiral screw arranged for receiving developers from the primary spiral screw and for conveying the received developers in a direction opposite to the conveyance direction of the primary spiral screw. The primary and secondary spiral screws have different conveyance capacities. An apertured receptacle mounted below the primary spiral screw feeds developers from the primary spiral screw to the secondary spiral screw.

7 Claims, 8 Drawing Figures

DEVELOPING SYSTEM FOR AN ELECTROSTATIC COPYING APPARATUS

BACKGROUND OF THE INVENTION

The present invention relates to a developing system for use in an electrostatic recording apparatus such as an electrophotographic copying apparatus.

Developing systems of this kind are already known in which a toner supply hopper is provided on one side or the other side of the width of an area to be developed. The hopper supplies toners in response to a toner replenishment signal when the density of toners or the density of an image pattern is low. As the toners thus supplied are conveyed along a gutter-like toner conveyance guide, i.e. a receptacle in the direction of the width of the area to be developed by means of a spiral screw, the toners are replenished through toner dropping holes provided substantially under the conveyance guide. In the meantime, toners running along the conveyance guide are formed in fine particles of the order of 1–20 $\mu$ and are insufficient in fluidity. Therefore an attempt has been made to improve the characteristics of both conveyance and dropping such toners through the toner dropping holes in the manner that a part of developers are moved or brought into the conveyance guide by means of a developer agitator provided inside the developing system and are then mixed up with the toners therein. In this case in particular, the developers are conveyed in one direction with respect to the developing system. Therefore, the developers tend not to be uniformly distributed in width direction.

As a result of the above difficulties, the inventors studied a system making use of a primary spiral screw and a secondary spiral screw mounted below the primary spiral screw, the secondary spiral screw conveying developers in the opposite direction to the conveyance direction of the primary spiral screw, thus moving the developers in both directions so that the developers may be evenly distributed. It was found that the quantity of developers inside the conveyance guide, i.e. the quantity of developers added thereinto, is limited in order to drop the replenished toners evenly in one direction, i.e. in the development width direction. Such limitation is apt to occur particularly when a developing system is small in size. In other words, if the quantity of the developers inside the conveyance guide is increased to increase the quantity of the developers conveyed to one side of the development width, i.e. in the direction of conveyance, the toner density on said one side becomes substantially higher. On the contrary, if the quantity of developers inside the conveyance guide is reduced to reduce the quantity of such developers conveyed to one side of the width, the toner density on the other side becomes substantially higher. As a result, the density distribution of the toners inside the developing system becomes uneven so that a corresponding unevenness of the density on an image pattern is apt to occur.

Possible solutions to the above-mentioned problem are to mix up replenished toners with a large quantity of developers and then drop the mixture thereof from a conveyance guide; or to improve the agitation capacity in the development width direction. In the former case, the time-lag of toner replenishment becomes longer, while in the latter case, it is unsuitable for reducing the cost of a copying apparatus and miniaturizing the size thereof.

It is an object of the invention to provide a developing system in which the above-mentioned disadvantages are eliminated; the even density of toners is obtained in a development width direction; and an excellent image pattern is reproduced even if such copying apparatus is low in cost and is small in size.

SUMMARY OF THE INVENTION

A developing system of the invention comprises means defining an area to be developed; means for supplying developers which include toners to said area; a primary conveyance means in communication with supplying means for conveying said developers comprising at least toners in one direction with respect to the width of said area to be developed; and a secondary conveyance means arranged for receiving said developers from said primary conveyance means and for conveying said received developers in a direction opposite to the conveyance direction of said primary conveyance means. The primary and secondary conveyance means have different conveyance capacities.

In this disclosure, the term "developers" means sometimes only toners in a wide sense, or a mixture of toners and carriers when such developers are two-component type developers.

DETAILED DESCRIPTION

Figure 1:
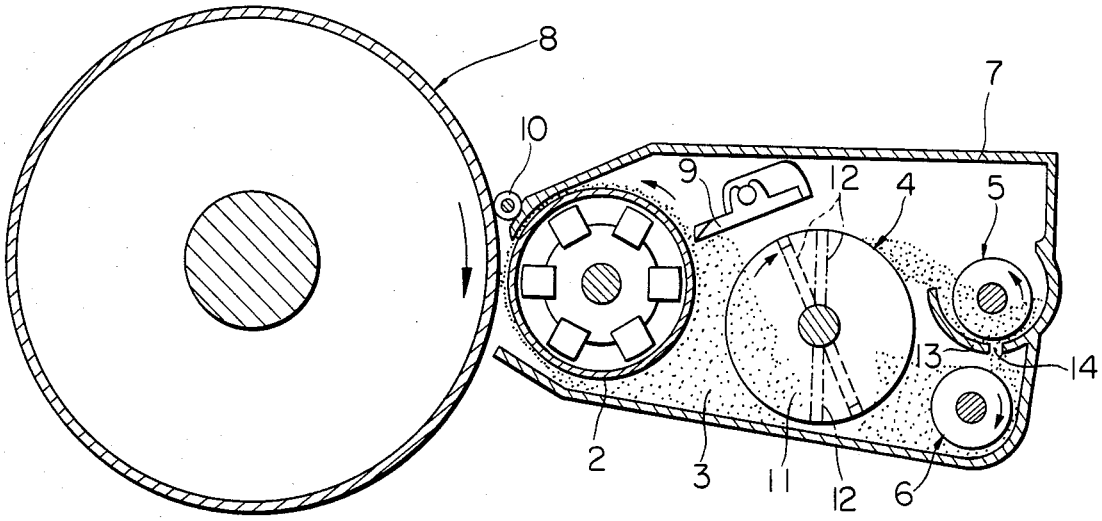
FIG. 1 is a cross-sectional view illustrating a dry and two-component type developing system and a photosensitive drum to which the present invention pertains.
Figure 3:
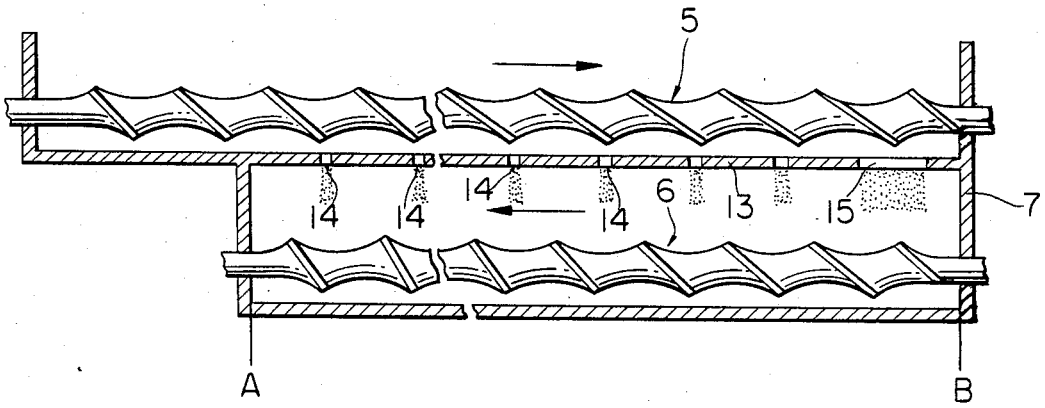
FIG. 3 is a sectional view taken substantially along the line X—X of FIG. 2.
Figure 2:
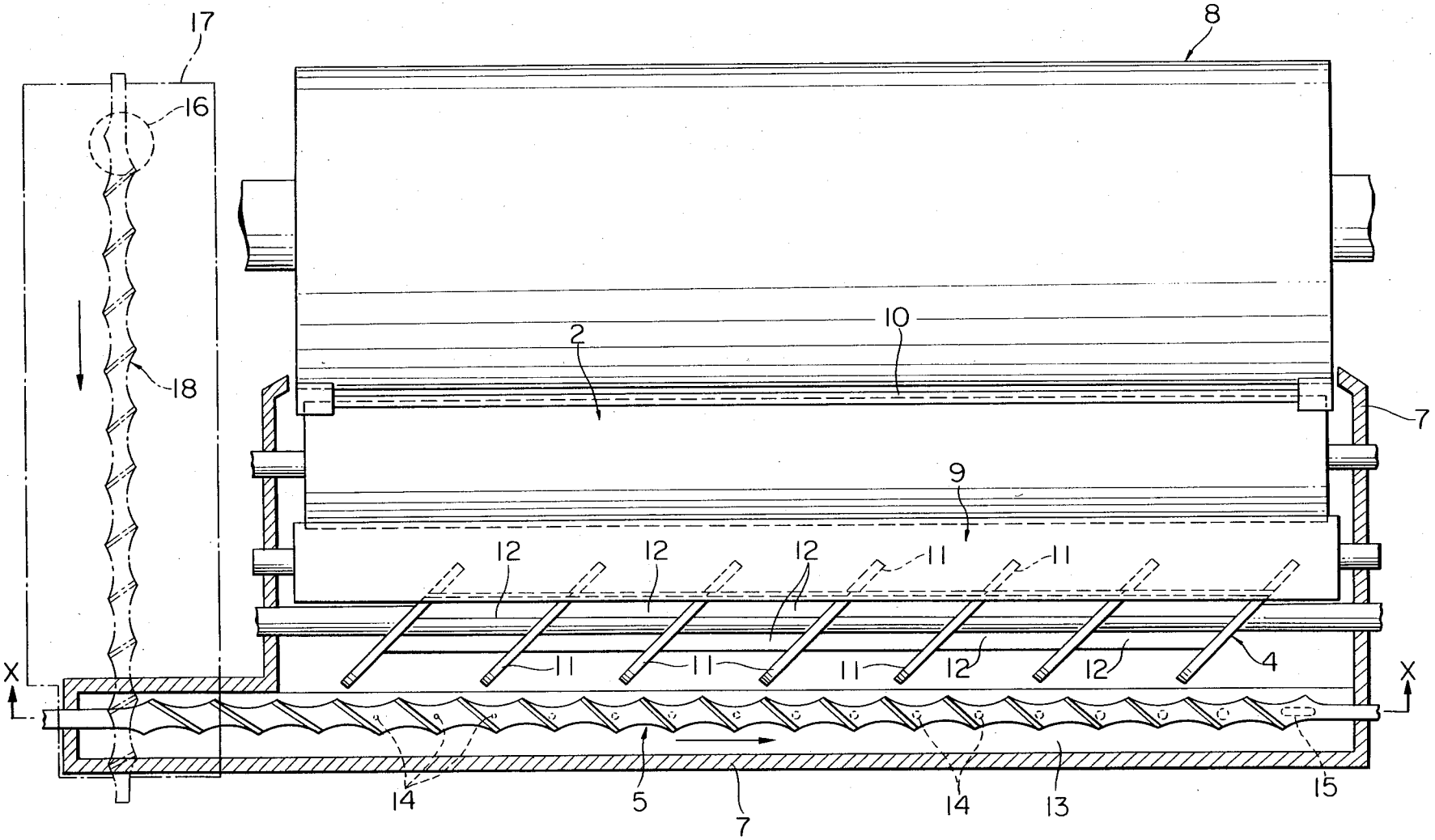
FIG. 2 is a partially sectional view, seen from above, illustrating the developing system shown in FIG. 1.

The drawings illustrate a dry two-component type developing system embodying the present invention. FIGS. 1–3 illustrate a developing system according to the invention which basically comprise a rotary developing sleeve 2 with built-in fixed magnets therein, a main agitator 4 for agitating developers 3, a primary spiral screw 5 for conveying replenished toners, a secondary spiral screw 6 mounted substantially under the primary spiral screw 5 for conveying and supplementally agitating developers 3, and a component casing or housing in which the above-mentioned components are arranged.

The developing sleeve 2 is arranged adjacent to a photoreceptor drum 8 to move the charge developers 3 (i.e., the mixture of toners and carriers) to the gap or spacing between the drum 8 and the sleeve 2. Then the developers 3 are electrostatically adsorbed onto the drum 8, and thus, an electrostatic latent image pattern is developed to form a corresponding toner image pattern.

The thickness of developers 3 attracted on the sleeve 2 is regulated by a fixed thickness regulating blade 9. A toner scatter prevention roller 10 is interposed between the drum 8 and the component housing 7 so as to prevent toners from whirling up around during development.

Main agitator 4 agitates and mixes up the developers and replenished toners by means of a plurality of elliptical agitating blades 11 which are fixed slantingly to the shaft of the agitator 4, and the mixture thus obtained is levelled thereby in the direction of the shaft. Between the elliptical agitating blades 11, flat plate members 12 are mounted along the major axes of the elliptical blades and the shaft of the main agitator 4 for agitating developers thoroughly and at the same time for scooping a part of the developers in the revolving direction of the main agitator 4 and then letting the developers fly on the side of the primary spiral screw 5 nearby the position indicated by a dot-dash-line in the quantitative proportion of, say, 5 g/sec–50 g/sec.

The primary spiral screw 5 functions to convey toners supplied at the one end up to the other end thereof, that is, in the development width direction. In the process of conveying the toners, it functions to drop the toners in order through a plurality of toner dropping holes 14 which are made substantially on the bottom of the toner receptacle 13, i.e., a conveyance guide, that is provided under the screw 5. In this instance, both of the replenished toners and a part of the developers having been moved or conveyed from the main agitator 4 are mixed up thoroughly by means of the screw 5 and are at the same time conveyed thereby in one direction. The mixture obtained is excellent in fluidity and is also satisfactory in the characteristics required for dropping from the holes 14. The conveyance guide 13 which serves as a receptacle for dropping the mixture has an opening having a suitable area upstream thereof so that the determinate amount of developer may be restored thereto from the main agitator 4, and it is arranged in a certain position relative to the main agitator 4. It is desirable to shape toner receptacle 13 generally into the form of a gutter as illustrated in the figures. The sizes of the toner dropping holes 14 successively increase in the conveyance direction of the screw 5 so that toner may be replenished in substantially uniform quantity in the same direction. The configuration, dimensions, and the rate of revolution of the screw 5 are determined respectively so that the conveyance may be satisfactorily performed from one end of the development width to the other in the direction of the development width. Hole 15, as seen in FIGS. 2 or 3, is a relatively lengthy hole for dropping out toner or developer overflowed at the downstream end of screw 5.

Secondary spiral screw 6 arranged substantially under the conveyance guide 13 is buried under developer powder 3 stored in the component housing 7. The screw 6 preliminarily agitates the developer powder 3 and the replenished toners being dropped through the holes 14, and it also moves the agitated mixture to the main agitator 4. In addition, the screw 6 conveys in the opposite direction the developers which were conveyed in one direction by the screw 5 or were replenished, and thus the screw 6 prevents such developers from distributing unevenly; that is, it prevents toner density from distributing unevenly.

How to supply toner to the screw 5 is that, as indicated by an imaginary line in FIG. 2, inside a replenishment chamber 17 having an opening 16 through which toner is added from a hopper (not shown) into the chamber 17, a spiral screw 18 for conveying toner is arranged above the screw 5 so that the screw 18 may be partially overlapped with one end of the screw 5. The toner is conveyed in a constant amount by the screw 18 and is then dropped from the end of the screw 18 onto the screw 5 located below screw 18. Thus, replenished toners are, as described above, conveyed in one direction by the screw 5.

In the behavior of developers being conveyed inside a system, the agitation efficiency of the developers is improved because the length of developer conveyance is made as long as possible making use of each of the above-mentioned four revolving members 2, 4, 5, 6, respectively incorporated even in a compact type developing system. For example, the replenished toners are mixed up with developers primarily in conveyance guide 13 by means of spiral screw 5 revolving counterclockwise and after dropping from the holes 14 the mixture thereof is agitated preliminarily by means of spiral screw 6 revolving clockwise, and further the agitated mixture is thoroughly agitated and mixed up well by means of main agitator 4, and is then conveyed to developing sleeve 2. The developers remaining on the developing sleeve 2, after a development process, are moved on with the sleeve 2 being revolved, and are then restored to the developing system.

A noteworthy point of the developing system embodied in the invention is that, to improve the functions of such a system by uniforming the toner density constantly in the development width direction even if such a system is miniaturized, the aforesaid primary spiral screw 5 and secondary spiral screw 6 are made different from each other in conveyance capacity.

Figure 4:
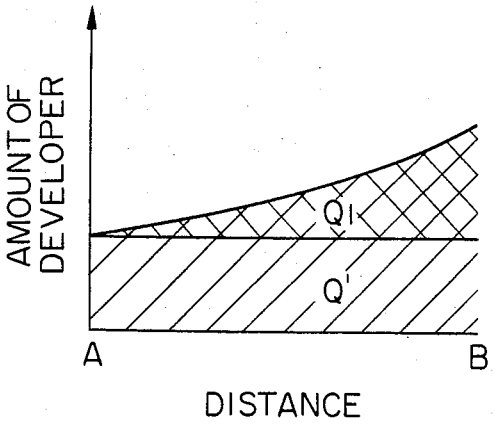
FIG. 4 is a graph illustrating the developer quantity conveyed by a primary spiral screw when the holes for dropping developers are open.
Figure 5:
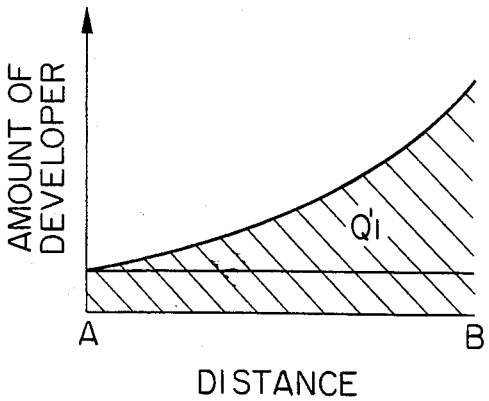
FIG. 5 is a graph illustrating the same as FIG. 4, but when the holes are stopped up.

Referring in detail to the drawings and first to FIG. 3 illustrating the above-mentioned point, primary screw 5 is so designed as to convey developers from the one end (designated A) of the screw 5 to the other (designated B) and as to drop the developers increasing in order during the conveyance process through the holes which successively increase in size from A to B. In this instance, the developers are conveyed by the revolution of primary screw 5 in the axial direction of screw 5. The substantial quantity $Q_1$ of the conveyance, as shown in FIG. 4, tends to relatively and gradually increase as the developers are conveyed closer to B, if the equivalent quantity Q' of the developers dropped in the direction perpendicular to the axle is subtracted from the total quantity of the developers. On the other hand, if such holes are stopped up, the developer quantity conveyed by screw 5 toward B is considerably varied after a certain period of elapsed time, as shown in FIG. 5. In contrast therewith, in FIG. 4 illustrating the case of dropping developers from holes 14, the quantity conveyed to B becomes relatively smaller, i.e., $Q_1 < Q_1'$.

Figure 6:
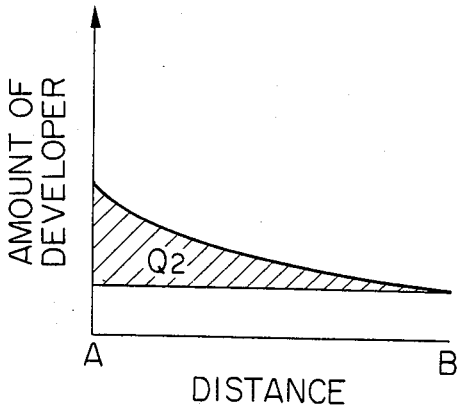
FIG. 6 is a graph illustrating the developer quantity conveyed by a secondary spiral screw.
Figure 7:
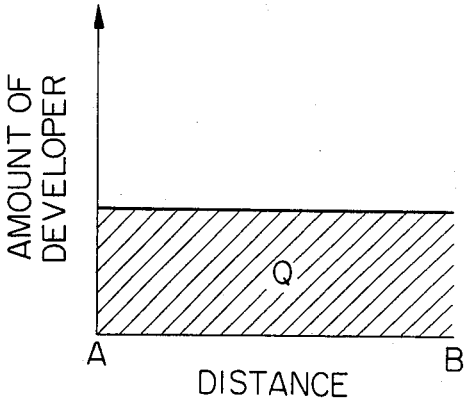
FIG. 7 is a graph illustrating the aggregate quantity of the developers in operation of both of the spiral screws.

Next, the measurement was made for the quantity of the developers remaining in the system after the developers were conveyed for a certain period of time by means of only the lower screw 6. The results thereof are shown in FIG. 6, wherein $Q_2$ designates the quantity of developers conveyed from B to A, in this instance. Accordingly, if the value of $Q_2$ is made substantially equal to the value of $Q_1$, i.e., $Q_1 \approx Q_2$, then the quantity Q in a system becomes almost uniform as shown in FIG. 7 and thus an uneven distribution of developers is prevented. As described above, the quantity $Q_1$, $Q_2$ of developers conveyed in the axial direction of the screw are substantially equalized by making the conveyance capacity $W_1$ of the primary conveyance means and the conveyance capacity $W_2$ of the secondary conveyance means different, and thus an uneven distribution of developers is prevented or substantially prevented from occurring.

The conveyance capacity W produced by a spiral screw is formulated as follows:

$$W = kVPN \quad (1)$$

wherein, V represents the volume ($cm^3$) of every one pitch of a screw; P represents the pitch (cm) of a screw; N represents the number of revolution per min.; and k represents a constant number.

It was also found that the following relation between the conveyance capacity of the two screws is necessary for substantially equalizing the conveyance quantity $Q_1$, $Q_2$ produced by screws 5, 6, respectively:

$$W_1 > W_2 \quad (2)$$

wherein, $W_1$ represents the conveyance capacity of primary screw 5 by itself; and $W_2$ represents a conveyance capacity of secondary screw 6 by itself.

Accordingly, it may be understood that, in order to satisfy the formula (2), at least one of V, P and N is to be adjusted according to the above formula (1) so that the following inequality formulas may be held true:

$$V_{S1} > V_{S2}$$

$$P_{S1} > P_{S2}$$

$$N_{S1} > N_{S2}$$

In this example, the above-given Formula (2) is effective by differentiating $V_{S1}$, $V_{S2}$ or $N_{S1}$, or $N_{S2}$ from each other, if $P_{S1}$ equals to $P_{S2}$.

To be more concrete, it is necessary to establish the following relation:

$$V_{S1}/V_{S2} > 1$$

$$N_{S1}/N_{S2} > 1$$

or $$P_{S1}/P_{S2} > 1,$$

and more desirably $$1.2 \leqq V_{S1}/V_{S2}(P_{S1}/P_{S2} \text{ or } N_{S1}/N_{S2}) \leqq 3$$

In other words, as is understandable from the explanation of the conveyance quantity of developers, if the ratio is less than 1, then it is impossible to obtain the relation of $Q_1 \approx Q_2$ between the conveyance quantity of developers and the two thereof are unequalized. However, when the ratio is limited within the above-mentioned scope, the relation of $Q_1 \approx Q_2$ can surely be obtained.

Figure 8:
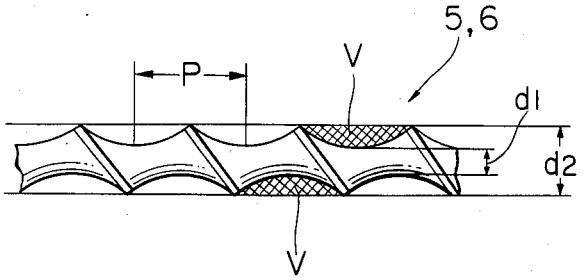
FIG. 8 is a partial diagrammatic front view illustrating a spiral screw, with the purpose of showing the developer quantity conveyed by the spiral screw.

Next, in the example, the design thereof was so made as to be $V_{S1} > V_{S2}$. Therefore, as shown in FIG. 8, the volume V of every one pitch of the spiral screw 5 or 6 is determined according to the pitch P, the inside diameter d1 and the outside diameter d2 of each of the screws. Accordingly, in this example, d1 and d2 and of the screws 5, 6 were fixed to be the same, and the relation between $P_{S1}$ and $P_{S2}$ was made to be $P_{S1} > P_{S2}$.

To be further more concrete, every value was fixed as follows:

$P_{S1} = 18$ mm (pitch of screw 5),
$P_{S2} = 10$ mm (pitch of screw 6),
d1 = 9 mm,
d2 = 17 mm, and
N = 130 rpm.

The other conditions were given as follows:

Inside diameter of conveyance guide = 22 mm,
Size of developer dropping hole = $\phi 1$–$\phi 4$,
Pitch of developer dropping hole = 5–20 mm, approx.,
Inside length of developing system = 340 mm, approx.,
Size of main agitator = $\phi 40$, and
Developer: There was used therein a carrier coated with an insulating resin, and the toner density thereof was not higher than 8% by weight.

In the same developing system, on the other hand, the relation between $N_{S1}$ and $N_{S2}$ was made to be $N_{S1} > N_{S2}$ and the following values were selectively applied thereto:

$N_{S1} = 130$ rpm
$N_{S2} = 90$ rpm
$P_{S1} = P_{S2} = 18$ mm,
d1 = 9 mm, and
d2 = 18 mm.

The above example may be variously modified in accordance with the technical concept of the invention.

Such modifications are possible, for example, by changing the arrangement of the above-mentioned spiral screws for conveyance use, or by providing not only a pair of the spiral screws but also three or more screws. Conveyance means other than the above-mentioned spiral screws may be used in the invention, and a variety of driving means may be adopted therefor. The invention may also be applied to developing systems other than those of two-component types.

In the invention, as described above, the conveyance capacity of the primary conveyance means is differentiated from that of the secondary one so that the conveyed quantity of both conveyance means may be made substantially or nearly equivalent in actual operation. Moreover, the conveyance directions of the two conveyance means are made opposite to each other. Therefore, the toner density is made uniform in the development width direction.

Uniform toner density is attained even with any compact and low-cost developing system. Therefore, it becomes possible to make the density of toner uniform and to reproduce an excellent image pattern without regard to the supply of toner to a system.

We claim:

1. In an electrostatic copying apparatus, a developing system comprising a developing means including means defining an area to be developed, and means for supplying developers which include toners to said area to be developed, the improvement comprising:

a primary conveyance means in communication with supplying means for conveying said developers comprising at least toners in one direction with respect to the width of said area to be developed;

a secondary conveyance means arranged substantially under said primary conveyance means for receiving said developers from said primary conveyance means and for conveying said received developers in a direction opposite to the conveyance direction of said primary conveyance means;

a receptacle having a plurality of holes therein, said receptacle being arranged under said primary conveyance means and interposed between said primary and secondary conveyance means for receiving conveyed developers from said primary conveyance means and dropping said received developers through said holes to said secondary conveyance means, said holes being spaced along the conveyance direction of said developers;

said primary and secondary conveyance means having different conveyance capacities; and agitating means arranged between said second conveyance means and said developing means, said agitating means including means for scooping up developers and causing scooped up developers to fly onto the primary conveyance means to mix with developers supplied from said supplying means.

2. The system of claim 1, wherein the holes are smaller in size at the beginning of said primary conveyance means than at the end of said primary conveyance means, taken in the conveyance direction of said primary conveyance means.

3. The system of claim 2, wherein the size of said holes gradually increases in said conveyance direction of said primary conveyance means.

4. The system of claim 3, wherein said primary and secondary conveyance means each comprise respective spiral screws.

5. The system of claim 4, wherein said secondary conveyance means has a conveyance capacity less than said primary conveyance means.

6. In an electrostatic copying apparatus, a developing system comprising means defining an area to be developed, and means for supplying developers which include toners to said area to be developed, the improvement comprising:

a primary conveyance means in communication with supplying means for conveying said developers comprising at least toners in one direction with respect to the width of said area to be developed, said primary conveyance means comprising a sprial screw;

a secondary conveyance means arranged substantially under said primary conveyance means for receiving said developers from said primary conveyance means and for conveying said received developers in a direction opposite to the conveyance direction of said primary conveyance means, said secondary conveyance means comprising a spiral screw;

said secondary conveyance means having a conveyance capacity less than said primary conveyance means;

feeding means interposed between said primary and secondary conveyance means for feeding said conveyed developers from said primary conveyance means to said secondary conveyance means, said feeding means comprising a receptacle having a plurality of holes therein, said receptacle being interposed between said primary and secondary conveyance means for receiving conveyed developers from said primary conveyance means and dropping said developers through said holes to said secondary conveyance means, said holes being spaced along the conveyance direction of said developers, said holes being smaller in size at the beginning of said primary conveyance means than at the end of said primary conveyance means, taken in the conveyance direction of said primary conveyance means, the sizes of said holes gradually increasing in said conveyance direction of said primary conveyance means;

said spiral screws of said primary and secondary conveyance means each having a respective conveyance capacity $W_1$, $W_2$ as follows:

$$W_1 = KV_{S1}P_{S1}N_{S1}$$

$$W_2 = KV_{S2}P_{S2}N_{S2}$$

wherein $V_{S1}, V_{S2}$ represents a volume ($cm^3$) of every one pitch of the respective screw; $P_{S1}, P_{S2}$ represents the pitch (cm) of the respective screw; $N_{S1}, N_{S2}$ represents a number of revolutions per min. of the respective screw; and K represents a constant number; and wherein the following formula is satisfied:

$$1.2 \leqq V_{S1}/V_{S2}(P_{S1}/P_{S2} \text{ or } N_{S1}/N_{S2}) \leqq 3.$$

7. In an electrostatic copying apparatus, a developing system comprising means defining an area to be developed, and means for supplying developers which include toners to said area to be developed, the improvement comprising:

a primary conveyance means in communication with supplying means for conveying said developers comprising at least toners in one direction with respect to the width of said area to be developed, said primary conveyance means comprising a spiral screw;

a secondary conveyance means arranged substantially under said primary conveyance means for receiving said developers from said primary conveyance means and for conveying said received developers in a direction opposite to the conveyance direction of said primary conveyance means, said secondary conveyance means comprising a spiral screw;

said secondary conveyance means having a conveyance capacity less than said primary conveyance means;

feeding means interposed between said primary and secondary conveyance means for feeding said conveyed developers from said primary conveyance means to said secondary conveyance means, said feeding means comprising a receptacle having a plurality of holes therein, said receptacle being interposed between said primary and secondary conveyance means for receiving conveyed developers from said primary conveyance means and dropping said developers through said holes to said secondary conveyance means, said holes being spaced along the conveyance direction of said developers, said holes being smaller in size at the beginning of said primary conveyance means than at the end of said primary conveyance means, taken in the conveyance direction of said primary conveyance means, the sizes of said holes gradually increasing in said conveyance direction of said primary conveyance means;

said spiral screws of said primary and secondary conveyance means each having a respective conveyance capacity $W_1$, $W_2$ as follows:

$$W_1 = KV_{S1}P_{S1}N_{S1}$$

$$W_2 = KV_{S2}P_{S2}N_{S2}$$

wherein $V_{S1}$,$V_{S2}$ represents a volume ($cm^3$) of every one pitch of the respective screw; $P_{S1}$,$P_{S2}$ represents the pitch (cm) of the respective screw; $N_{S1}$,$N_{S2}$ represents a number of revolutions per min. of the respective screw; and K represents a constant number; and wherein the following relations are satisfied:

$$V_{S1}/V_{S2} > 1$$

$$N_{S1}/N_{S2} > 1$$

or $$P_{S1}/P_{S2} > 1.$$

* * * * *